United States Patent [19]

Houser

[11] Patent Number: 4,466,686

[45] Date of Patent: Aug. 21, 1984

[54] SWITCH CONNECTION ADAPTER

[75] Inventor: John M. Houser, Pickens, S.C.

[73] Assignee: The Singer Company, Stamford, Conn.

[21] Appl. No.: 456,176

[22] Filed: Jan. 6, 1983

Related U.S. Application Data

[63] Continuation of Ser. No. 225,483, Jan. 15, 1981, abandoned.

[51] Int. Cl.[3] ..... H01R 23/10; H01R 27/00

[52] U.S. Cl. ..... 339/196 M; 339/32 R; 339/58; 339/95 D

[58] Field of Search ..... 339/58, 95 D, 195, 196, 339/147 P, 258 R, 32 R, 32 M, 33

[56] References Cited

U.S. PATENT DOCUMENTS

| | | | |
|---|---|---|---|
| 1,722,816 | 7/1929 | Meunier | 339/147 P |
| 1,997,270 | 4/1935 | Titus | 339/95 D |
| 2,830,280 | 4/1958 | Webber | 339/147 P |
| 2,942,231 | 6/1960 | Cornell, Jr. | 339/258 R |
| 3,007,129 | 10/1961 | Nielsen | 339/198 P |
| 3,182,281 | 5/1965 | Salz, Sr. | 339/258 R |
| 3,296,576 | 1/1967 | Motten, Jr. | 339/195 R |

FOREIGN PATENT DOCUMENTS

| | | | |
|---|---|---|---|
| 365546 | 12/1922 | Fed. Rep. of Germany | 339/196 R |
| 1022287 | 1/1958 | Fed. Rep. of Germany | 339/195 R |
| 1965056 | 7/1971 | Fed. Rep. of Germany | 339/196 R |
| 568097 | 3/1945 | United Kingdom | 339/195 M |
| 703093 | 1/1954 | United Kingdom | 339/195 M |

*Primary Examiner*—Neil Abrams

*Attorney, Agent, or Firm*—Edward P. Schmidt; Robert E. Smith; Edward L. Bell

[57] ABSTRACT

A connection adapter module for a wire trap switch, trigger speed control, or the like that plugs into the wire trap system and provides screw clamp connections to the control for a portable electric tool such as a drill, sabre saw, or the like, enabling the tool to be rewired or the control replaced by a customer with a standard screwdriver, comprising an insulator body carrying a plurality of connector elements and which can be "piggy-backed" on the control, connector elements generally comprising inserts in the insulator body including a barrel portion having a screw threaded through the wall thereof for receiving and clamping a wire therewithin and a thin wire-like projection or pin portion extending longitudinally therefrom projecting out of the insulator body to be engaged within the switch or control wire trap.

6 Claims, 4 Drawing Figures

SWITCH CONNECTION ADAPTER

This application is a continuation of application Ser. No. 225,483, filed Jan. 15, 1981 now abandoned.

DESCRIPTION

FIELD OF THE INVENTION

This invention relates to portable electric tools and, more particularly, to switch connector adapters therefore.

BACKGROUND OF THE INVENTION

A wire trap connection system has become popular for trigger speed controls and switches in portable electric tools such as drills, sabre saws, and the like. In such a system, a switch or trigger speed control module is provided with a housing having a plurality of openings into which tinned stranded wire or solid wire ends may be inserted to connect the switch or speed control module. Within the opening is a spring wire trap which grasps the wire end while making an electrical connection thereto.

While such wire trap systems are compatable with Underwriters Laboratory (UL) and Canadian Standards Association (CSA) requirements, these systems do not comply with the standards of some other nations. In Europe, for example, it is generally necessary that the cord be easily replaceable by the customer. While some wire trap systems do enable easy replacement by the customer, some require special tools and some are not amenable to easy customer rewiring.

The wiring system that is most commonly recognized as being easily rewired is the use of screws to clamp each wire, thereby allowing the changes to be made by the customer using just a screwdriver.

OBJECTS OF THE INVENTION

Bearing in mind the foregoing, it is a primary object of the present invention to provide a connection adapter to provide screw terminals for a switch or trigger speed controller incorporating a wire trap connection system.

Another primary object of the present invention, in addition to the foregoing object, is the provision of such an adapter which is economical and allows economical wire trap controls to be utilized for tools to be sold in nations requiring easy serviceability and rewiring by the customer.

Still another primary object of the present invention, in addition to each of the foregoing objects, is the provision of a simple, inexpensive adapter enabling the provision of screw clamp terminals on switches and trigger speed controls utilizing wire trap connection.

The invention resides in the combination, construction, arrangement and disposition of the various component parts and elements incorporated in a connection adapter and portable electric tools incorporating the same in accordance with the principles of this invention. The present invention will be better understood and objects and important features other than those specifically enumerated above will become apparent when consideration is given to the following details and description which, when taken in conjunction with the annexed drawing describes, discloses, illustrates and shows a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved, especially as they fall within the scope and spirit of the subjoined claims.

SUMMARY OF THE INVENTION

A connection adapter module is provided for a wire trap switch, trigger speed control, or the like that plugs into the wire trap system and provides screw clamp connections to the control for a portable electric tool such as a drill, sabre saw, or the like, enabling the tool to be rewired or the control replaced by a customer with a standard screwdriver. The connection adapter module comprises an insulator body carrying a plurality of connector elements which can be "piggy-backed" on the control. The module includes connector elements generally comprising inserts in the insulator body including a barrel portion having a screw threaded through the wall thereof for receiving and clamping a wire therewithin and a thin wire-like projection or pin portion extending longitudinally therefrom projecting out of the insulator body to be engaged within the switch or control wire trap.

DESCRIPTION OF THE DRAWING

While the specification concludes with claims particularly pointing out and distinctly claiming the subject matter which is regarded as forming the present invention, it is believed the invention will be better understood from the following detailed description when taken in conjunction with the annexed drawing which discloses, illustrates and shows a preferred embodiment or modification of the present invention and what is presently considered and believed to be the best mode of practicing the principles thereof and wherein:

DETAILED DESCRIPTION OF THE INVENTION

Figure 1:
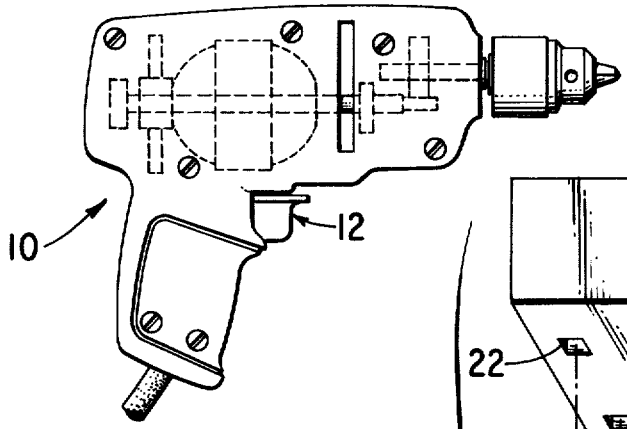
FIG. 1 illustrates a representative portable electric tool incorporating the present invention.
Figure 2:
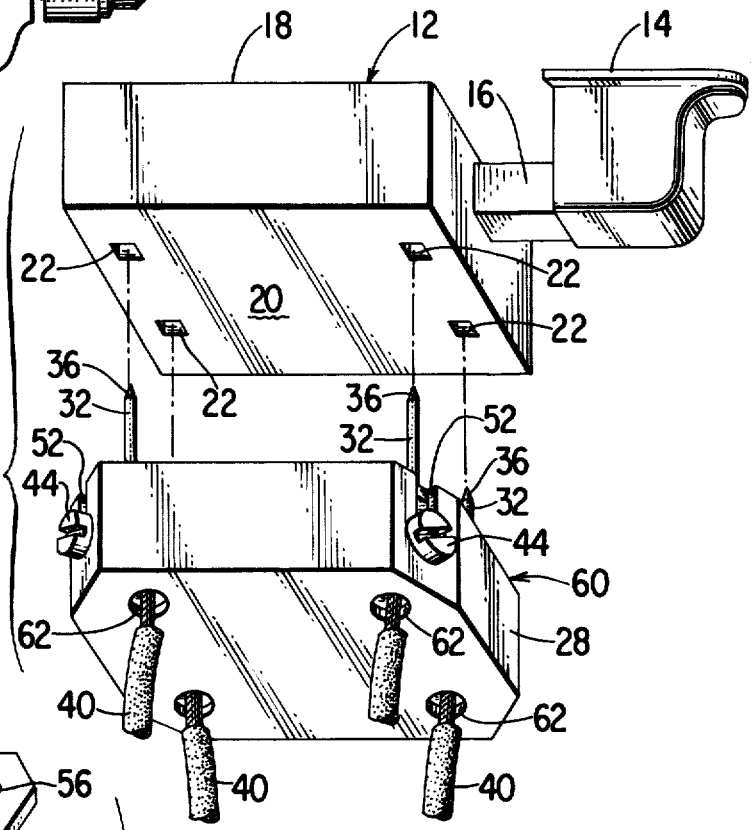
FIG. 2 is an exploded perspective view of the trigger switch module and connection adapter block or module of the present invention illustrating how a trigger control utilizing a wire trap system can be converted to screw terminal connection.
Figure 3:
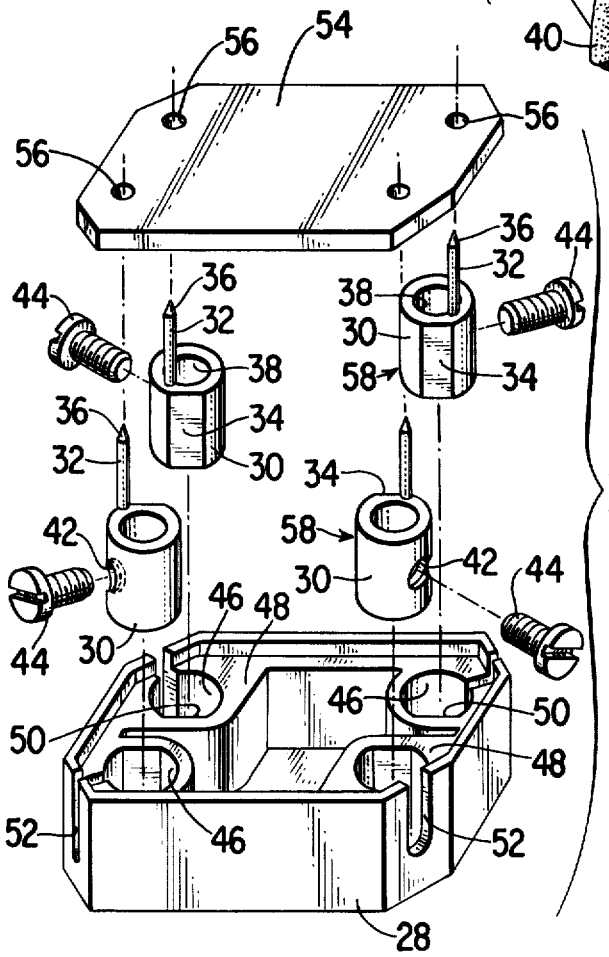
FIG. 3 is an exploded perspective illustration of the connection adapter module of the present invention.
Figure 4:
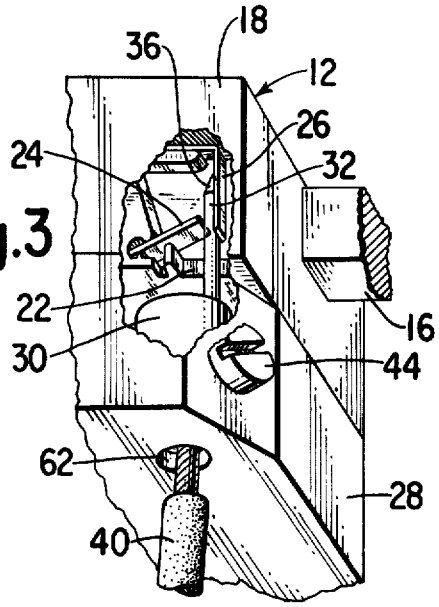
FIG. 4 is an enlarged partial perspective illustration partially broken away, illustrating the interconnection of the adapter with a control.

With reference now to the drawing, there is shown and illustrated an appliance or portable electric tool, such as a portable electric drill designated generally by the reference character 10 which incorporates a trigger control 12 which may be a trigger switch or a trigger speed control and which generally comprises a trigger portion 14 carried on the end of a slide portion 16 which is telescopable inwardly and outwardly of a housing 18. The housing 18 includes a cover plate 20 provided with a plurality of apertures 22 providing access to a wire trap connection system within the housing 18. Mounted with the slide 16 within the housing 18 is at least one contact which cooperates with other components within the housing 18 to control electric circuits leading to wire trap contact members or conductors 24 and 26 mounted within the housing 18 inwardly of each of the holes 22. The wire trap system and trigger switch controls utilizing these systems are well known and are commercially available from a number of switch and control manufacturers. In the wire trap system detailed in FIG. 4, if a wire end, having been previously stripped, and preferably tinned if the wire is stranded, is inserted through the aperture 22 and between the elements 24 and 26, the wire end becomes jammed or wedged between the contact members 24 and 26. Entering easily, after being inserted any force applied to the wire tending to withdraw it wedges it very tightly between the contact members 24 and 26.

In the adapter of the present invention there is provided an adapter body 28 which carries. in general alignment with each of the apertures 22, an insert comprising a connector body 30 of generally barrel or cylindrical shape which has extending generally longitudinally outwardly thereof a pin portion 32. The generally cylindrical barrel shaped portions 30 may be provided with alignment means, such as a flatted or slabbed surface 34 to aid in their assembly with the connector body 28. The pin portions 32 may be provided with conical points 36 to aid in the insertion thereof into the wire trap system between the contact members 24 and 26. Further, the generally cylindrical barrel portions 30 are provided with a generally axial bore 38 adapted to receive therewithin the wiring 40 of the tool 10 transverse threaded holes 42 may also be provided communicating with the central or axial bore 38 to receive clamping screws 44 for clamping the wiring 40 of the tool 10 within the generally cylindrical barrel portions 30.

To receive the generally cylindrical barrel portions 30, the housing 18 may be provided with a plurality of generally cylindrical bores 46 within bosses 48, the generally cylindrical bores 46 being provided with flatted portions 50 for mating with the flatted portion or slabbed sides 34 of the generally cylindrical barrel portions 30 so as to provide alignment therebetween and preclude relative rotation. Screw slots 52 may also be provided in the housing 18 to provide clearance for passage of the shanks of the clamping screws 44 therethrough. The generally cylindrical barrel portions 30 may be assembled into the generally cylindrical bores 46 and an apertured cover plate 54 may be assembled with the body 28 with the pin portions 32 extending through the apertures 56 thereof and the cover plate 54 secured to the body 28 in any convenient manner such as ultrsonic bonding, adhesive bonding, or the like.

The generally cylindrical barrel portions 30 together with the elongated pin portion 32 is generally referred to as an insert, designated generally by the reference character 58 and, as should be readily apparent, is fabricated of electrically conductive material. The body 28 and cover plate 54 should be fabricated of electrically non-conductive or insulating material. The assembled adapter, including the body 28, the cover plate 54, the insert 58, and the clamping screws 44 define an adapter or module generally designated by the reference character 60 which contains the generally cylindrical portion 30 of the inserts 58 within the body 28 and has the pin portions 32 of the inserts 58 extending outwardly thereof through the cover plate 54 and positioned so as to be alignable with the apertures 22 of the trigger control 12. The adapter 60 can therefore be plugged into the control 12, thereby effectively and inexpensively converting the control 12 from a wire trap system device to one having provision for screw clamp connection to wiring 40 thereto, the adapter body 28 being also provided with apertures 62 in alignment with the central apertures or bores 38 of the generally cylindrical barrel portions 30 of the inserts 58 enabling, as shown, the wiring 40 of the tool 10 to be inserted therethrough and clamped within the inserts 58. The inserts 58 provide an electrical path between the wires 40 and the wire trap system conductors 24 and 26 of the trigger control 12. If replacement of the wiring 40 is required, only a screwdriver is needed, to loosen and re-tighten the wire clamping screws 44.

While the invention has been described, disclosed, illustrated and shown in terms of a preferred embodiment or modification which it has assumed in practice, it is to be expressely understood that this has been done for purposes of example only and that the invention is not intended to be deemed limited thereby, and that other embodiments or modifications that may be suggested to those having the benefit of the teachings herein are intended to be reserved especially as they fall within the scope and spirit of the claims here appended.

I claim:

1. Arrangement for converting a wire trap connection system for receiving stripped wire end to establish a connection which becomes tighter on any attempt to withdraw said wire, to screw clamp connection in a portable electric tool having a housing and a switch control supported internally of said tool housing and having a wire trap system for connection thereto, said arrangement having a connection adapter module for permanent insertion into said wire trap system internally of said housing to provide screw clamp connections to said switch control for the portable electric tool enabling the tool to be rewired or said switch control replaced by a customer with a standard screwdriver, comprising: an insulator body piggy-backed on said switch control; and a plurality of connector elements carried by said instulator body, said connector elements each comprising an insert including a hollow portion captured within said insulator body for receiving a wire therein and having a screw threaded through the wall of said portion and accessible externally of said insulator body for clamping said wire within said portion, and a thin wire-like projection extending from said portion projecting out of the insulator body to be permanently engaged with said switch control wire trap system.

2. Connection adapter module defined in claim 1 wherein the portions are provided with alignment means, such as a flatted or slabbed surface to aid in their assembly with the connector body and the body comprises a housing provided with a plurality of bores provided with flatted portions for mating with said flatted or slabbed surfaces so as to provide alignment therebetween and preclude relative rotation.

3. Connection adapter module defined in either of claims 1 or 2 wherein said wire-like projections are provided with conical points to aid in the insertion thereof into the wire trap system.

4. Portable electric tool having a housing, a switch control supported internally of said tool housing and having a wire trap system for receiving a stripped wire end to establish a connection which becomes tighter on any attempt to withdraw said wire, and a connection adaptor module for permanent insertion internally of said housing in said wire trap system to provide screw clamp connections to said control enabling the tool to be rewired or said control replaced by a customer with a standard screwdriver, comprising: an insulator body piggy-backed on said switch control; and a plurality of connector elements carried by said insulator body, said connector elements each comprising an insert including a hollow portion captured within said insulator body for receiving a wire therein and having a screw threaded through the wall of said portion and accessible externally of said insulator body for clamping said wire therewithin and a thin wire-like projection extending from said portion and projecting out of the insulator body to be permanently engaged with said switch control wire trap system.

5. Tool defined in claim 4 wherein the portions are provided with alignment means, such as a flatted or slabbed surface to aid in their assembly with the connector body and the body comprises a housing provided with a plurality of bores provided with flatted portions for mating with the flatted slabbed surfaces so as to provide alignment therebetween and preclude relative rotation.

6. Tool defined n either of claims 4 or 5 wherein said wire-like projections are provided with conical points to aid in the insertion thereof into the wire trap system.

* * * * *